US012123288B2

(12) United States Patent
Lindsey et al.

(10) Patent No.: US 12,123,288 B2
(45) Date of Patent: Oct. 22, 2024

(54) VAPOR RECOVERY TURBO COMPRESSOR

(71) Applicant: ESTIS COMPRESSION, LLC, Kilgore, TX (US)

(72) Inventors: Chris Lindsey, Carthage, TX (US); Will Nelle, San Angelo, TX (US)

(73) Assignee: ESTIS COMPRESSION, LLC, Kilgore, TX (US)

( * ) Notice: Subject to any disclaimer, the term of this patent is extended or adjusted under 35 U.S.C. 154(b) by 81 days.

(21) Appl. No.: 18/095,246

(22) Filed: Jan. 10, 2023

(65) Prior Publication Data

US 2023/0220749 A1 Jul. 13, 2023

Related U.S. Application Data

(60) Provisional application No. 63/298,125, filed on Jan. 10, 2022.

(51) Int. Cl.

| | |
|---|---|
| ***E21B 43/12*** | (2006.01) |
| ***F04D 17/10*** | (2006.01) |
| ***F04D 25/02*** | (2006.01) |

(52) U.S. Cl.

CPC ..... *E21B 43/121* (2013.01); *F04D 17/10* (2013.01); *F04D 25/026* (2013.01)

(58) Field of Classification Search

CPC ..... E21B 43/121; F04D 17/10; F04D 25/026
See application file for complete search history.

(56) References Cited

U.S. PATENT DOCUMENTS

| | | | | |
|---|---|---|---|---|
| 4,115,040 | A * | 9/1978 | Knorr | H02K 49/104 310/104 |
| 4,277,707 | A * | 7/1981 | Silver | H02K 49/106 310/104 |
| 5,484,265 | A * | 1/1996 | Horvath | F04D 13/025 417/63 |
| 6,460,350 | B2 | 10/2002 | Johnson | |
| 6,460,360 | B2 | 10/2002 | Hsieh | |
| 8,109,738 | B2 | 2/2012 | Vogt | |
| 9,410,426 | B2 | 8/2016 | Beeler | |
| 9,482,235 | B2 * | 11/2016 | Small | F04D 25/026 |
| 2001/0042376 | A1 | 11/2001 | Johnson | |
| 2010/0158717 | A1 | 6/2010 | Vogt | |
| 2017/0045272 | A1 * | 2/2017 | Bandhauer | F01K 11/02 |

(Continued)

FOREIGN PATENT DOCUMENTS

| | | | |
|---|---|---|---|
| AU | 2001031247 | A1 | 8/2001 |
| AU | 777111 | B2 | 9/2004 |
| CA | 2399094 | A1 | 8/2001 |

(Continued)

*Primary Examiner* — Eldon T Brockman
(74) *Attorney, Agent, or Firm* — FisherBroyles, LLP; Jason P. Mueller

(57) ABSTRACT

A vapor recovery turbo compressor is provided for recovering low pressure hydrocarbon vapors from tanks, oil or gas wells or other low-pressure sources. The vapor recovery turbo compressor includes a turbo expander that receives high pressure hydrocarbon gas that drives the turbo expander. The turbo expander drives a vapor recovery compressor. The vapor recovery compressor receives very low-pressure hydrocarbon gas from tanks and other sources and generates medium pressure hydrocarbon gas that can be used for various purposes.

20 Claims, 2 Drawing Sheets

(56) References Cited

U.S. PATENT DOCUMENTS

| | | | |
|---|---|---|---|
| 2022/0081996 | A1 | 3/2022 | Rydland |

FOREIGN PATENT DOCUMENTS

| | | | |
|---|---|---|---|
| CA | 2399094 | C | 10/2008 |
| EP | 1254335 | A1 | 11/2002 |
| EP | 1254335 | B1 | 7/2011 |
| WO | 2001057430 | A1 | 8/2001 |

* cited by examiner

VAPOR RECOVERY TURBO COMPRESSOR

CROSS-REFERENCE

The present application claims the benefit of the filing date of U.S. Provisional Application No. 63/298,125 having a filing date of Jan. 10, 2022, the entire contents of which is incorporated herein by reference.

BACKGROUND

The present disclosure is directed to a vapor recovery turbo compressor that recycles, compresses and expands for use, low pressure hydrocarbon gas that would otherwise be emitted into the atmosphere. The present disclosure is also directed to a method of recycling low pressure hydrocarbon gas released from oil and gas wells.

DESCRIPTION

Figure 1:
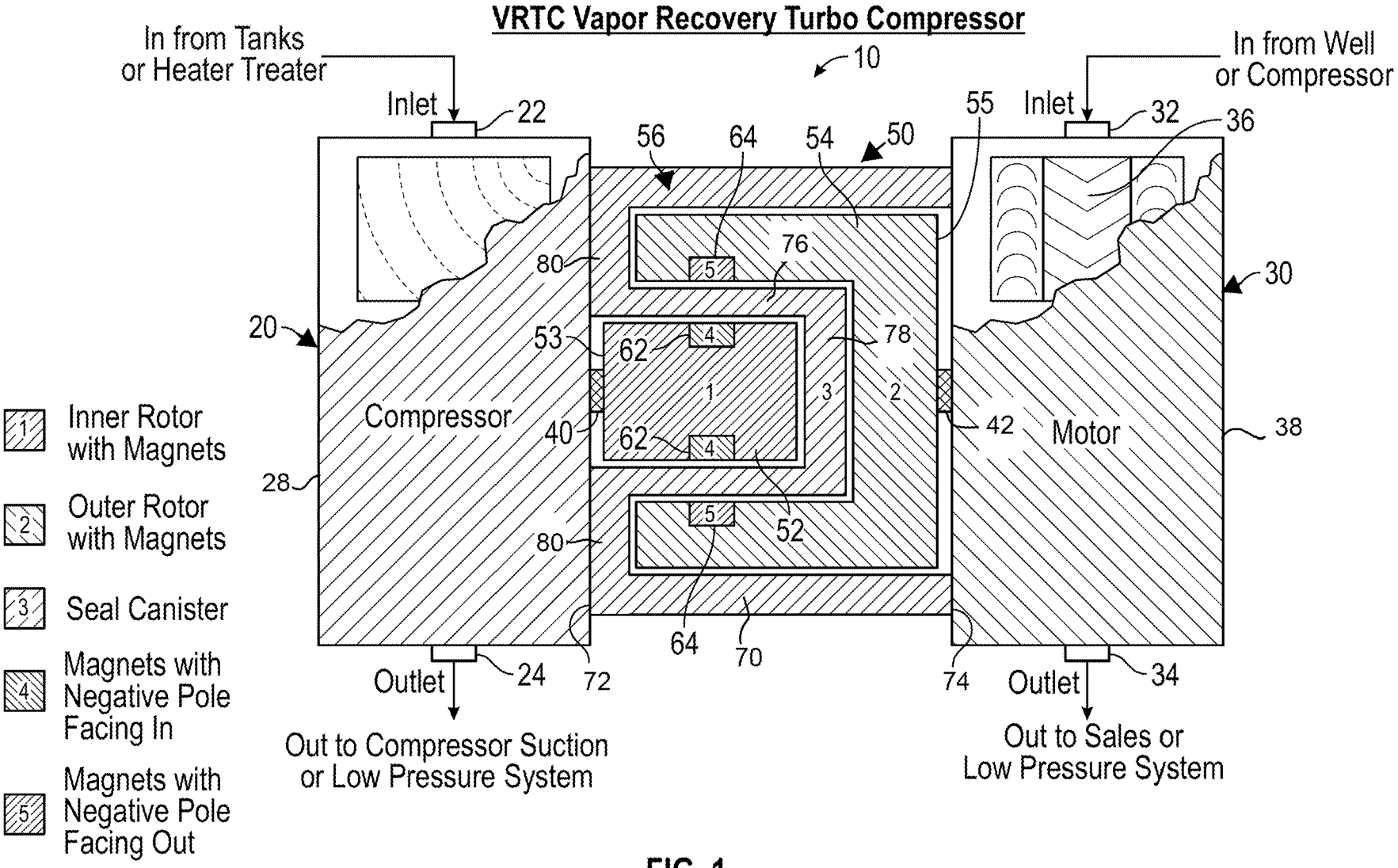
FIG. 1 schematically illustrates one embodiment of a vapor recovery turbo compressor of the disclosure.

During normal production of oil and gas from wells, the conventional release of low-pressure hydrocarbon gas into the atmosphere is disadvantageous both from an environmental and an economic standpoint. Methane is a significant, if not a primary component of low-pressure gas emissions from wells. For example, natural gas typically contains, in percent by volume, about 70% to nearly 100% methane, about 0-20% propane, and smaller amounts of ethane, butane, carbon dioxide, oxygen, nitrogen and hydrogen sulfide. Methane is a potent greenhouse gas with an estimated global warming potential orders of magnitude greater than that of carbon dioxide. Low pressure hydrocarbon gases emitted from various sources of oil and gas well are difficult to recapture as the pressure of these gases is below the well pressure and/or a sales line leading from the well. The pressure of the gas must be increased to allow its injection back into the oil and gas well system. The difficulty in increasing the pressure of such low pressure gases, due in part to often remote locations (e.g., on-shore and off-shore), conventionally results in flaring these gases. The conventional flaring of low-pressure methane-containing gases has been employed to break them down to carbon dioxide and water vapor. This flaring has been estimated to contribute 300 million tons of carbon dioxide to the atmosphere annually, representing an annual economic loss of approximately $2 billion.

Turbo compressors have been used in cryogenic plants that remove hydrocarbons from gas streams. Turbo compressors are machines that compress and concentrate a compressible gas using dynamic principles. The lower pressure gas is fed to a rotating impeller which transfers mechanical shaft power to the gas, resulting in significant increases in temperature and pressure. The compressed gas can either be collected or transferred to a second compressor stage with the help of a return channel.

The present disclosure is directed to a vapor recovery turbo compressor that includes a first compressor (e.g., low pressure vapor recovery compressor), a turbo expander, and a coupling between the first compressor and the turbo expander. The first compressor can be configured to capture hydrocarbon vapor gas emitted from a source, compress the captured hydrocarbon gas, and feed the compressed hydrocarbon gas to a low-pressure system. The first compressor can be but is not limited to a reciprocating compressor or a centrifugal compressor. The source can be but is not limited to an oil or gas well, a tank, a heater, or another compressor. The low-pressure system can be but is not limited to the suction side of an additional compressor or a gas sales system. The coupling can be but is not limited to an indirect coupling such as a magnetic coupling as described below.

The turbo expander can be configured to receive and process a stream of high-pressure hydrocarbon gas that enables the turbo expander to act as a motor for the first compressor. The high-pressure hydrocarbon gas can be provided to the turbo expander at pressures of about 500 to about 2000 psig (about 35 to about 135 atmospheres), or about 600 to about 1500 psig (about 40 to about 100 atmospheres), or about 800 to about 1200 psig (about 55 to about 80 atmospheres). The turbo expander can include a radial inflow expansion turbine and can be connected to the first compressor by a shaft and the coupling. The turbo expander depressurizes the high-pressure hydrocarbon gas and, in the process, acts as a motor to help drive the first compressor. The depressurization and conversion of stored potential energy to kinetic energy results in a lower pressure hydrocarbon gas stream exiting from the turbo expander. The lower pressure hydrocarbon gas stream exiting from the turbo expander can be fed to the same low-pressure system including, for example, the aforementioned suction side of an additional compressor or a gas sales system. The use of a turbo expander as a motor for the first compressor is beneficial as a power source for the turbo expander is readily available. Specifically, high pressure gas, which is commonly available at an oil and gas well, is used to power the turbo expander, which in turn powers the first compressor. No additional power sources (e.g., electrical, generators etc.) are required to operate the vapor recovery turbo compressor. This can be especially beneficial in remote locations often associated with oil and gas wells (e.g., on-shore and off-shore).

A second compressor can be part of an overall system that incorporates the vapor recovery turbo compressor. The second compressor can be configured to receive a stream of lower pressure gas, compress it to the aforementioned higher pressures, and the high-pressure gas can then be fed to the turbo expander to drive the turbo expander. The second compressor can be a reciprocating compressor, a centrifugal compressor, or another suitable compressor. The gas received by the second compressor can come from an oil or gas well or from some other source.

The coupling between the first compressor and the turbo expander can be an indirect coupling. In this regard, no shaft extends directly between the turbo expander, which is internally exposed to high pressure gases, and the first compressor, which is internally exposed to low and medium pressure gases. Such indirect coupling eliminates the need for high pressure seals between the first compressor and the turbo expander which, if used, would require periodic maintenance, replacement, and down time. The remote location of many oil and gas wells makes such periodic maintenance unattractive. In one embodiment, the indirect coupling is a magnetic coupling. In one embodiment, the magnetic coupling can include at least one inner rotor with magnets, at least one outer rotor with magnets, and a seal canister between the inner rotor and the outer rotor. The seal canister may also extend between and seal to the housings of the first compressor and the turbo expander. The inner rotor can have a cylindrical shape and can be connected to the first compressor via a shaft. In one embodiment, the inner rotor can include one, two, three, four, or more inner rotor magnets extending at least partly around, or evenly spaced around an outer circumference of the inner rotor. The inner rotor magnets can be positioned at or near an outer perimeter of the inner rotor. Each inner rotor magnet can have a positive pole and a negative pole, and the respective negative poles can face inward toward the center of the inner rotor.

The outer rotor can have a cylindrical shape and can surround the inner rotor on all sides except for one end of the inner rotor connected to the first compressor. The outer rotor can be connected to the turbo expander via a shaft. The outer rotor can include one, two, three, four or more outer rotor magnets extending at least partway around, or evenly spaced around an inner circumference of the outer rotor. The outer rotor magnets can be positioned at or near an inner perimeter of the outer rotor. Each outer rotor magnet can have a positive pole and a negative pole, and the respective negative poles can face outward so that the positive poles of the outer rotor magnets face toward the positive poles of the inner rotor magnets. In an alternative embodiment, the inner rotor magnets and outer rotor magnets can have their poles reversed so that the negative poles of the outer rotor magnets face inward toward the outward-facing negative poles of the inner rotor magnets.

The outer rotor, outer rotor magnets, inner rotor, and inner rotor magnets together form a magnetic coupling that couples the shaft of the turbo expander to the shaft of the compressor. Thus, energy realized by gas expanding in the turbo expander, which rotates the turbo expander may be used to drive/rotate the compressor.

The inner and outer rotors of the magnetic coupling can be separated by a seal canister that fills a cylindrical space between the inner and outer rotors and surrounds the outer rotor on all sides except one end of the outer rotor connected to the turbo expander. One feature of the magnetic coupling is that it avoids the need for high pressure oil seals between the first compressor and the turbo expander which, if used, would require periodic maintenance, replacement, and down time.

FIG. 1 schematically illustrates one embodiment of a vapor recovery turbo compressor 10 of the disclosure. The vapor recovery turbo compressor 10 includes a first compressor 20, a turbo expander 30 that acts as a motor for the compressor 20, and a magnetic coupling 50 between the compressor 20 and turbo expander 30. The first compressor 20 includes a compressor (e.g., a reciprocating compressor or a centrifugal compressor) disposed within a housing 28. The first compressor 20 receives low pressure hydrocarbon gas through a housing inlet 22 from a source which can be a tank, oil or gas well, another compressor, or another source. When driven (e.g., rotated) via a first shaft 40, the first compressor 20 compresses the low pressure hydrocarbon gas and releases it through a housing outlet 24 which can lead to a low pressure system for storage or sale, or to a suction side of another compressor. The first compressor 20 can receive the hydrocarbon gas vapor from a relatively low-pressure source and can compress it to a higher pressure suitable for recovery (e.g., via injection into a flow line of an oil and gas well).

The first compressor 20 can be driven by the turbo expander 30, which can act as a motor for the first compressor 20. The turbo expander 30 can receive high pressure hydrocarbon gas from a source, for example, at a pressure of about 500 to about 2000 psig (about 35 to about 135 atmospheres), or about 600 to about 1500 psig (about 40 to about 100 atmospheres), or about 800 to about 1200 psig (about 55 to about 80 atmospheres). The source of the high-pressure hydrocarbon gas can be a second compressor (see, e.g., second compressor 120 of FIG. 2) that is different from the first compressor. The gas that is fed into the turbo expander 30 can be hydrocarbon gas from an oil or gas well that has been compressed by a second compressor before being fed into the turbo expander 30. Either way, the vapor recovery turbo compressor 10 provides a way to increase the pressure of low pressure hydrocarbon gas that would otherwise have been vented into the atmosphere and put it to use, such as by converting the recovered low pressure hydrocarbon gas to a saleable form.

The turbo expander 30 expands the high-pressure hydrocarbon gas to a lower pressure and, in the process, transfers much of its stored energy potential into kinetic energy that drives the compressor 20. High pressure hydrocarbon gas enters a housing 38 of the turbo expander 30 through a housing inlet 32, which can embody or lead to a network of variable guide vanes 36. The incoming gas approaches an expansion wheel (not shown) disposed within the housing 38, causing it to rotate and turn an output or second shaft 42 which, in turn, drives or helps to drive the first compressor 20 via the first shaft 40. Internal expander nozzles are used to control conditions such as the flow rate and rate of pressure reduction. As the hydrocarbon gas expands, it not only drives the expansion wheel of the turbo expander, but also cools and depressurizes. The depressurized hydrocarbon gas exits the turbo expander 30 through the outlet 34 and can then be fed to a sales system or to another low-pressure system, or to a suction side of another compressor, or to a recycle line that feeds it back into the first compressor 20.

The coupling between the turbo expander 30 and the compressor 20 is an indirect coupling. That is, an output shaft 42 of the turbo expander 30 does not directly drive an input shaft 40 of the compressor. Such indirect coupling eliminates any leakage or other passage of high-pressure gas within the housing 38 of the turbo compressor 30 to the low to mid pressure gas within the housing 28 of the vapor recovery compressor 20. In an embodiment, the present disclosure utilizes a magnetic coupling. The magnetic coupling 50 eliminates the need for pressurized oil seals and other kinds of seals that can entail significant maintenance and down time. The magnetic coupling 50 can include an inner rotor 52, an outer rotor 54, and a sealing canister 56 disposed between the inner and outer rotors as well as the first compressor and turbo expander. The sealing canister fluidly isolates the turbo expander and the first compressor as is further discussed below. The inner rotor 52 can have a cylindrical configuration and can include a plurality of inner rotor magnets 62 disposed at even spacings around, and at or near an outer periphery of the cylindrical inner rotor 52. The inner rotor magnets 62 can each have a positive pole and a negative pole and can be oriented with their negative poles facing inward toward each other and toward a center of the cylindrical inner rotor 52. The number of inner rotor magnets 62 can vary depending on the size of the magnetic coupling 50. The inner rotor magnets 62 are typically evenly spaced around or near the outer circumference of the inner rotor 52. A first end 53 of the inner rotor 52 is coupled to the compressor within the housing 28 of the first compressor 20. In an embodiment, the inner rotor 52 is attached to the compressor via the first shaft 40.

As illustrated in FIG. 1, the outer rotor 54 can be cylindrical with a hollow interior that surrounds the inner rotor 54. In this regard, the outer rotor may rotate around an outside surface of the inner rotor 52. The outer rotor 54 can include outer rotor magnets 64 disposed at even spacings around, and at or near an inner periphery of the cylindrical outer rotor 54. The outer rotor magnets 64 can each have a positive pole and a negative pole and can be oriented with their negative poles facing outward so that their positive poles face inward toward the outwardly facing positive poles of the inner rotor magnets 62. The number of outer rotor magnets 64 can vary depending on the size of the magnetic coupling 50 and can match the number of inner rotor magnets 62 in the inner rotor 52. The outer rotor magnets 64 are typically evenly spaced around or near the inner circumference of the outer rotor 62. A first end 55 of the outer rotor 54 is attached to the expansion wheel within the housing 38 of the turbo expander 30 via the second shaft 42.

In some embodiments, the orientation of the poles of the inner and outer magnets 62/64 could be altered in such a way that adjacent magnets 62 on the inner rotor 52 have alternating pole orientations and adjacent magnets 64 on the outer rotor 54 also have alternating pole orientations. The numbers of magnets provided, and their pole orientations are a design choice and can be varied to achieve various purposes. In any configuration, rotation of the outer rotor 54 caused by the expansion of gases within the housing 38 of the turbo expander 30 imparts rotation to the inner rotor 52 which is coupled to the compressor within the housing 28 of the vapor recovery compressor 20. That is, magnetic coupling between the inner and outer rotors allows the turbo expander to rotate the compressor via an indirect coupling, which allows for fully isolating the turbo expander 30 and the compressor 20. Further, rotation of the compressor increases the pressure of the low-pressure gases so they may be effectively recovered.

As illustrated, the seal canister 56 is disposed between the inner and outer rotors and also extends between the housing 28 of the compressor 20 and the housing 38 of the turbo expander 30. The seal canister fluidly isolates the turbo expander from the compressor. As shown, the seal canister 56 has an outer annual sidewall 70 (e.g., closed geometric shape not necessarily circular) that extends between the housing 28 of the first compressor 20 and the housing 38 of the turbo expander. More specifically, a first end 72 is attached to the housing 28 of the compressor and a second end 74 is attached to the housing 38 of the turbo expander. The outer annular sidewall 70 surrounds the inner and outer rotors 52, 54. The outer rotor 54 and its shaft 42 extend into an interior of the seal canister 56 through the interior of the second end 74. The inner rotor 52 and its shaft 40 extend into an interior of the seal canister through the first end 72 of the seal canister and into the interior of an inner sidewall 76 of the seal canister. As shown, the outer sidewall may form a sealed connection between the housings of the compressor and turbo expander. In addition, the annular inner wall 76 of the seal canister fluidly isolates the first rotor 52 from the second rotor 54. The annular inner wall 76 surrounds an outer cylindrical surface of the inner rotor 52 and is disposed within an interior of an inner cylindrical surface of the outer rotor 54. The inner sidewall 78 also includes a first end cap 78 about is upper edge (e.g., edge disposed at the free end of the inner rotor). The seal canister also includes an end cap 80 (e.g., annulus shaped cap) extending between the ends of the outer wall 70 and inner wall proximate to the compressor housing 28. The inner wall, outer wall and end caps, fluidly isolate the outer rotor from the inner rotor. Therefore, even if high pressure fluid leaked from a seal about the shaft 42 connecting the outer rotor 54 to the turbo expander 30, such high-pressure fluid would be contained within the seal canister between the inner and outer sidewall. No fluid could leak into the compressor 20. Likewise, any fluid leaking form the compressor 20 would be contained within the inner housing 78. Accordingly, the magnetic coupling provides a robust connection between the compressor and turbo expander which eliminates the need for any seals reducing maintenance requirements. Of note, the seal canister 56 can be formed of an electrically conductive and/or ferromagnetic metal or another material that enables transmission of magnetic currents created by interactions between the inner rotor magnets 62 and the outer rotor magnets 64.

Figure 2:
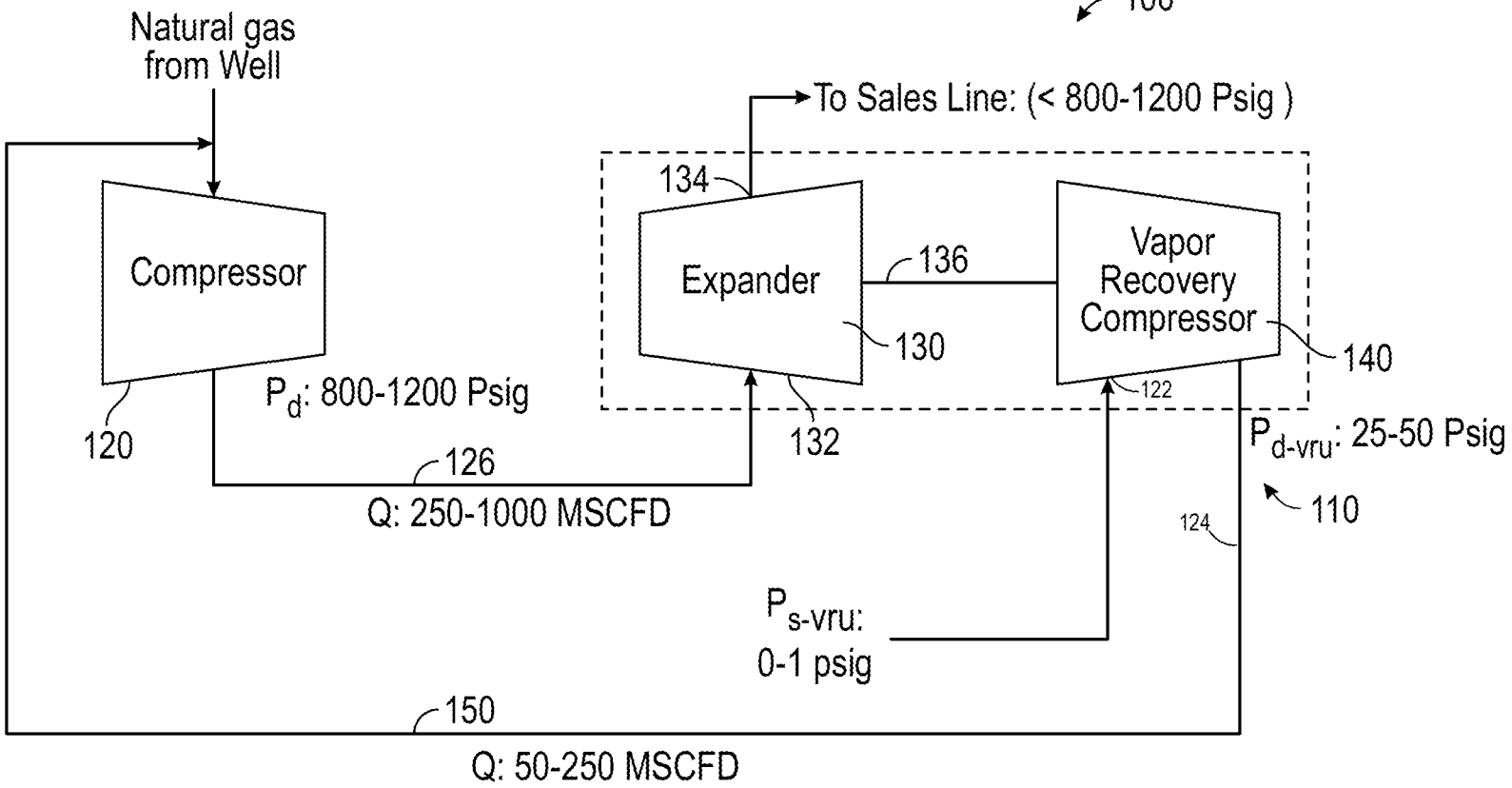
FIG. 2 schematically illustrates one embodiment of a system including a vapor recovery turbo compressor that is specifically configured to receive and use low pressure gas emitted from a well or recovered from tanks.

FIG. 2 schematically illustrates a system that can be used to recover hydrocarbon containing vapors or gasses from tanks and oil and gas wells. The illustrated system 100 includes a vapor recovery turbo compressor 110 that includes a vapor recovery compressor 140 which is coupled to a turbo expander 130 via a coupling (not shown). In this system 100, gas from a well is provided to a second compressor 120 that compresses the gas to relatively high pressures, such as 800-1200 psig. In some embodiments, the compressed gas may be provided at a rate of 250-1000 MSCFD (thousands of standard cubic feet per day). The compressed gas produced by the second compressor 120 is provided to the turbo expander 130 of the vapor recovery turbo compressor 110.

The turbo expander 130 decompresses the natural gas to a lower pressure that is suitable for sale and can transmit the depressurized natural gas to a sales outlet line 134. Alternatively, the turbo expander 130 may recycle some of the depressurized natural gas by feeding it via recovery line 136 to the vapor recovery compressor 140. Using the compressed gas from the first compressor 120 as an energy source, the turbo expander 130 drives the vapor recovery compressor 140.

The vapor recovery compressor 140 receives gas at very low or essentially no pressure from tanks or other sources, which may include oil and gas wells, via inlet 122. The vapor recovery compressor 140 then generates medium pressure gas that can be sent to the inlet of the second compressor 120 via a return line 124. In some embodiments, the compressed gas generated by the vapor recovery compressor 140 can be provided at 25-50 psig and at a flow rate of 50-250 MSCFD. In alternate embodiments, it may be possible for the vapor recovery compressor 140 to provide compressed gas to the sales line 134.

In methods according to the present disclosure, low pressure hydrocarbon gas from oil or gas wells or other sources is first compressed by a first compressor to relatively high pressures such as about 500 to about 2000 psig (about 35 to about 135 atmospheres), or about 600 to about 1500 psig (about 40 to about 100 atmospheres), or about 800 to about 1200 psig (about 55 to about 80 atmospheres). This high-pressure gas is then fed into a turbo expander. The compressed hydrocarbon gas is then used to drive the turbo expander, resulting in the turbo expander outputting a lower pressure hydrocarbon gas. The gas output by the turbo expander can be at pressures of less than about 500 psig (about 35 atmospheres), or less than about 400 psig (about 27 atmospheres), or less than about 300 psig (about 20 atmospheres), or less than about 200 psig (about 14 atmospheres), or less than about 150 psig (about 10 atmospheres), or less than about 100 psig (7 atmospheres), or less than about 50 psig (about 3.4 atmospheres), or less than about 30 psig (about 2 atmospheres). Next, the motive force generated by the turbo expander drives a vapor recovery compressor that compresses very low-pressure gas obtained from tanks and other sources. The vapor recovery compressor generates medium pressure gas that can be used for various purposes. The method can include providing the medium pressure gas generated by the vapor recovery compressor to a sales line, or perhaps back to the compressor that generated the high-pressure gas that drives the turbo expander.

The vapor recovery turbo compressor and the foregoing method provide an environmentally advantageous, cost-efficient alternative to prior art techniques that either released the low-pressure hydrocarbon gas from tanks or oil and gas wells directly into the atmosphere, or that burned it resulting in increased carbon dioxide release, or that tried to recover it using less effective and less cost-efficient techniques. Using the vapor recovery turbo compressor, it is estimated that at least 60%-95% of the low-pressure hydrocarbon gas released from tanks and oil and gas wells can be recovered and put to an economically productive use.

The invention claimed is:

1. A vapor recovery turbo compressor, comprising:

a vapor recovery compressor having a housing with an inlet and an outlet, wherein the vapor recovery compressor is configured to receive low pressure hydrocarbon gas from a vapor recovery compressor inlet and to compress the hydrocarbon gas to a higher pressure gas, wherein the higher pressure gas exits the vapor recovery compressor through a vapor recovery compressor outlet connected to a return line; and a turbo expander having a housing with a turbo expander inlet for receiving high-pressure gas, wherein expansion the high-pressure gas within the housing of the turbo expander rotates an output of the turbo expander, wherein lower pressure gas exits the turbo expander through a turbo expander outlet;

an indirect coupling connecting the output of the turbo expander to an input of the vapor recovery compressor for rotation; and wherein the return line is fluidly connected to one of:

a gas stream connected to the turbo expander inlet; and a gas stream connected to the turbo expander outlet.

2. The vapor recovery turbo compressor of claim 1, wherein the indirect coupling comprises a magnetic coupling.

3. The vapor recovery turbo compressor of claim 2, wherein the magnetic coupling comprises:

a first magnetic rotor attached to the input of the vapor recovery compressor; and a second magnetic rotor attached to the output of the turbo expander.

4. The vapor recovery turbo compressor of claim 3, wherein the first magnetic rotor is an inner rotor and the second magnetic rotor is an outer rotor, wherein the inner rotor is at least partially disposed within the outer rotor.

5. The vapor recovery turbo compressor of claim 4, wherein the inner rotor is attached to a shaft of the vapor recovery compressor and the outer rotor is connected to a shaft of the turbo expander.

6. The vapor recovery turbo compressor of claim 3, further comprising:

a seal canister, the seal canister extending between the housing of the vapor recovery compressor and the housing of the turbo compressor, the seal canister having an outer sidewall surrounding the first and second rotors and sealing the rotors between the housings.

7. The vapor recovery turbo compressor of claim 6, the seal canister further comprising:

an inner sidewall, the inner sidewall surrounding one of the first and second rotors and fluidly isolating the first and second rotors.

8. The vapor recovery turbo compressor of claim 7 wherein one of the first and second rotors is disposed between the outer sidewall and the inner sidewall.

9. The vapor recovery turbo compressor of claim 7, wherein at least the second sidewall is an electrically conductive metal.

10. The vapor recovery turbo compressor of claim 1, wherein the turbo expander receives the high-pressure gas from a second compressor.

11. The vapor recovery turbo compressor of claim 10, wherein the second compressor receives hydrocarbon gas from an oil or gas well and generates the high-pressure gas that is received by the turbo expander.

12. The vapor recovery turbo compressor of claim 10, wherein the higher pressure gas generated by the vapor recovery compressor is provided to an inlet of the second compressor through the return line.

13. The vapor recovery turbo compressor of claim 1, wherein the turbo compressor receives the high-pressure gas at pressures of between about 600 psig and about 1500 psig.

14. The vapor recovery turbo compressor of claim 1, wherein the turbo expander outlet provides the lower pressure gas exiting the turbo expander to a gas sales line.

15. A method of recovering hydrocarbon gas, comprising:

receiving, at a turbo expander, high pressure hydrocarbon gas that is used to drive an output shaft of the turbo expander, wherein a lower pressure hydrocarbon gas exits the turbo expander;

indirectly coupling the output shaft of the turbo expander to an inlet shaft of a vapor recovery compressor, wherein the indirect coupling rotates the vapor recovery compressor;

compressing a low pressure hydrocarbon gas with the vapor recovery compressor to generate an increased pressure hydrocarbon gas; and comingling the increased pressure hydrocarbon gas with a gas stream associated with one of:

the high pressure hydrocarbon gas received by the turbo expander; and the lower pressure hydrocarbon gas exiting the turbo compressor.

16. The method of claim 15, wherein indirectly coupling comprises magnetically coupling a magnetic rotor attached to the inlet shaft of the vapor recovery compressor to a magnetic rotor attached to the outlet shaft of the turbo expander.

17. The method of claim 15, further comprising:

fluidly isolating the magnetic rotor attached to the inlet shaft of the vapor recovery compressor from the magnetic rotor attached to the outlet shaft of the turbo expander.

18. The method of claim 15, wherein the vapor recovery compressor receives low pressure hydrocarbon gas from one or more tanks.

19. The method of claim 15, wherein the turbo expander receives the high-pressure hydrocarbon gas from a high-pressure compressor.

20. The method of claim 15, further comprising providing the medium pressure hydrocarbon gas generated by the vapor recovery compressor to an inlet of the high-pressure compressor.

* * * * *